US007140493B2

(12) United States Patent
Fry

(10) Patent No.: US 7,140,493 B2
(45) Date of Patent: Nov. 28, 2006

(54) TONGUE LOCK FOR STACKABLE CONTAINERS

(75) Inventor: Stanley L. Fry, West Covina, CA (US)

(73) Assignee: International Paper Company, Memphis, TN (US)

( * ) Notice: Subject to any disclaimer, the term of this patent is extended or adjusted under 35 U.S.C. 154(b) by 187 days.

(21) Appl. No.: 10/392,032

(22) Filed: Mar. 19, 2003

(65) Prior Publication Data

US 2003/0213836 A1 Nov. 20, 2003

Related U.S. Application Data

(60) Provisional application No. 60/366,475, filed on Mar. 20, 2002, provisional application No. 60/365,481, filed on Mar. 19, 2002.

(51) Int. Cl.
*B65D 21/036* (2006.01)
*B65D 43/00* (2006.01)

(52) U.S. Cl. ..... 206/509; 229/125.29; 229/915

(58) Field of Classification Search ..... 206/508, 206/509, 503; 220/4.27, 23.6, 784, 788, 220/676; 229/125.28, 125.29, 148, 178, 229/198.2, 199, 915, 125.11
See application file for complete search history.

(56) References Cited

U.S. PATENT DOCUMENTS

| | | | | |
|---|---|---|---|---|
| 393,899 A | | 12/1888 | Haines | |
| 1,425,914 A | | 8/1922 | Swift, Jr. | |
| 1,600,396 A | | 9/1926 | Campbell et al. | |
| 1,914,845 A | | 6/1933 | Cook | |
| 2,333,244 A | * | 11/1943 | Wesley | 229/120.1 |
| 2,676,745 A | | 4/1954 | Geisler | |
| 2,719,808 A | | 10/1955 | Elmendorf | |
| 2,868,433 A | | 1/1959 | Anderson, Jr. | |
| 2,933,228 A | | 4/1960 | Guyer | |
| 3,006,523 A | | 10/1961 | Keith | |
| 3,307,994 A | | 3/1967 | Scott, Jr. | |
| 3,486,680 A | * | 12/1969 | Negus, Jr. | 229/120.1 |
| 3,623,650 A | | 11/1971 | Watts | |
| 3,713,579 A | * | 1/1973 | Chaffers | 206/509 |
| 4,077,095 A | * | 3/1978 | Oliff | 403/381 |
| 4,134,534 A | | 1/1979 | Scott et al. | |
| 4,140,267 A | | 2/1979 | Scott et al. | |
| 4,339,292 A | | 7/1982 | Itoh et al. | |
| 4,389,013 A | | 6/1983 | Hall et al. | |
| 4,451,515 A | | 5/1984 | Clausen et al. | |
| 4,452,837 A | | 6/1984 | Clausen et al. | |
| 4,550,048 A | * | 10/1985 | Nakagawa | 428/138 |
| 4,646,917 A | | 3/1987 | Schuster | |
| 4,718,597 A | * | 1/1988 | Bishop | 229/117.16 |
| 4,757,938 A | * | 7/1988 | Collins | 229/120.05 |
| 4,804,138 A | | 2/1989 | McFarland | |

(Continued)

*Primary Examiner*—Nathan J. Newhouse
*Assistant Examiner*—Harry Grosso
(74) *Attorney, Agent, or Firm*—Thomas W. Barnes, III; Daniel C. Stelter; Dennis H. Lambert

(57) ABSTRACT

A substantially flat and planar dust cover has at least one opening formed through it near at least one edge for receiving a stacking tab on an open-topped container when the dust cover is applied to the container. A narrow strip of material is defined between the opening and an outer edge of the dust cover, and a strip of reinforcing tape is embedded within the edge of the dust cover to reinforce the narrow strip of material and prevent tearing of it or surrounding portions of the dust cover. A tongue shaped friction lock is integrally formed in the opening to capture the stacking tab.

9 Claims, 3 Drawing Sheets

U.S. PATENT DOCUMENTS 5,285,957 A 2/1994 Halsell
5,468,564 A 11/1995 Ohtani et al.
5,535,942 A * 7/1996 Vilona ..... 229/199
5,975,286 A * 11/1999 Oliff ..... 206/140
6,302,323 B1 * 10/2001 Southwell ..... 229/164
6,315,123 B1 * 11/2001 Ikeda ..... 206/434
6,354,487 B1 3/2002 Muise, Jr.
6,481,619 B1 * 11/2002 Jackson ..... 229/169
6,604,675 B1 * 8/2003 Southwell ..... 229/164
2001/0048022 A1 12/2001 Zoeckler

* cited by examiner

FIG. 1
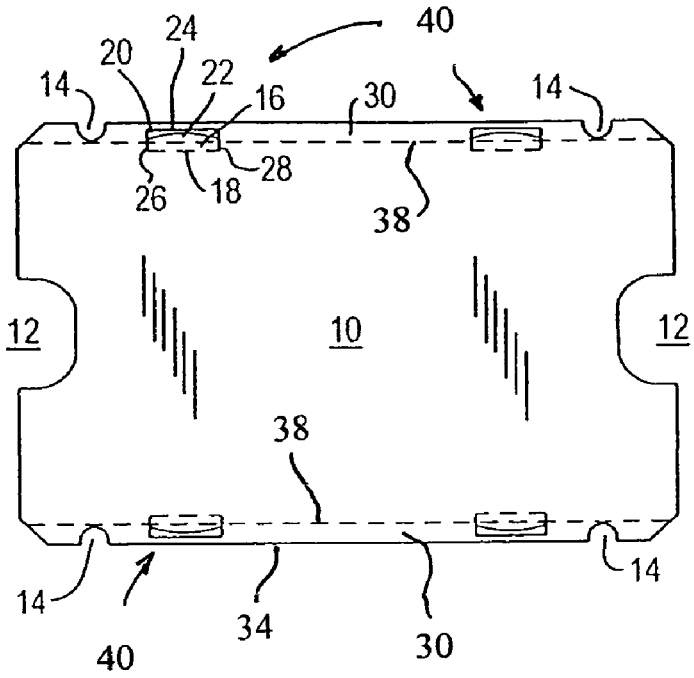
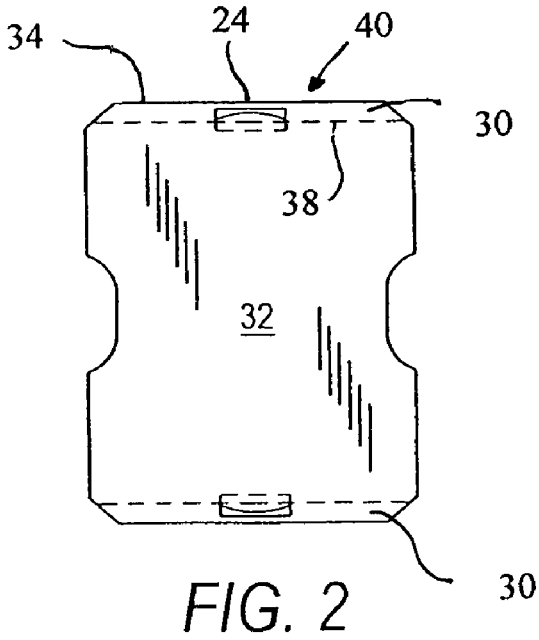
FIG. 2

TONGUE LOCK FOR STACKABLE CONTAINERS

RELATED APPLICATIONS

This application claims the benefit of U.S. Provisional Application Ser. No. 60/365,481 filed Mar. 19, 2002 and Ser. No. 60/366,475 filed on Mar. 20, 2002, the disclosures of which are incorporated herein by reference.

FIELD OF THE INVENTION

The present invention relates to a frictional lock mechanism for securing a dust cover onto an open-topped container, wherein the container has stacking tabs upwardly extending from its top edge. Specifically, the invention relates to a frictional lock mechanism having a locking flap than can pivot upwards along a back pivot line, thereby accepting and pressing against stacking tabs of an adjacent container. Additionally, the invention relates to a dust cover having a reinforced edge.

BACKGROUND OF THE INVENTION

Corrugated paperboard is typically used in many different applications, for example, to form containers, boxes, cartons, or dividers for holding, storing, stacking or shipping various items such as agricultural produce.

Typically, such containers have a bottom panel and four side walls, and are formed from a blank scored with score lines or cut lines. The containers are frequently open-topped containers, with male member stacking tabs extending upward from the top edges of the side walls and complimentary female member cut-out slots in the bottom panel or side wall of the container. During use, the stacking tabs of an open-topped container may be inserted into the slots cut out of an. adjacent container thereby enabling stacking of the containers on top of one another.

Such stacking of adjacent containers is only possible if the pattern of the cut-out slots are configured in the same pattern as the stacking tabs. This is made easier by the fact that such tabs and cut-out slots are, with increasing frequency, configured in a common footprint, such that the pattern and placement of the tabs and slots follow an industry standard.

When shipping or stacking open-topped containers, the top container in a stack, or an individual container not in a stack, is left uncovered. In these circumstance, a dust cover, which is a flat piece of flexible material that is flexible enough to bend but firm enough to create firm frictional connections, such as paperboard, is often placed on top of the open container. The dust cover mimics the bottom panel of an adjacent container, as if it were separated from the container's side walls. It is usually a substantially rectangular corrugated paperboard with several cut out slots configured a common footprint to accept the stacking tabs of an open-topped container.

Problems arise when the cut out slots do not accept the tabs in a firm and secure manner. This creates loose fitting stacks that are prone to toppling, or loose fitting dust covers that are prone to easy and premature removal. As a result, some slots are coupled with friction locks, wherein an extension of the bottom panel or dust cover presses against the tab as it extends through the cut out slot, creating a positive frictional force between the lock and the tab.

However, these friction locks have a short life span. Frequent use and re-use of the locks lowers the ability of the locks to maintain strong frictional contact with the stacking tabs. This diminished capacity often comes in the form of fraying or disfigurement of the lock, which prevents the lock form being able to adequately press against the tab. Further, tab locking mechanisms are inwardly spaced a small margin. from the edge of the bottom panel or dust cover, leaving a small strip of paperboard between the edge and the lock. Much like the locks themselves, the narrow strip of flexible material that lies between the lock and the edge of the bottom panel or dust over often tears or frays and wears out, further loosening the connection.

Further, prior art friction locks can only contact the tabs if the tabs are of sufficient thickness such that they rub against the lock. This creates a problem when the tabs are thin enough so that they extend through the cut out slot without significantly touching the friction lock. In these circumstances the lock's functional capacity is impaired, as there is insufficient friction to hold the tab in place securely. Along similar reasoning, variations in the size of the open-topped container are problematic, as the locks can only accept tabs of an exact formation. Thus, a container that is slightly thinner, for example, by ⅛ of an inch, requires an entirely different dust cover with locks inwardly spaced an additional ⅛ of an inch to achieve proper friction locking.

Therefore, it is an object of this invention to provide a friction lock that has sufficient durability to sustain frequent use and can securely hold stacking tabs of various thicknesses and from containers of various widths.

SUMMARY OF THE INVENTION

The present invention comprises an improved friction lock made out of a flexible material, such as paperboard, that is integrally cut and scored on the bottom panel of a container or in the edge portion of a dust cover for the purpose of securing and holding stacking tabs that extend upwardly from the top of an open-topped container. The friction lock comprises a cut out slot shaped to accept stacking tabs coupled with a tongue shaped flap for operably contacting the stacking tabs as they extend though the open slot. The tongue shaped flap projects into the slot from one side thereof, such that the outer edge of the tongue shaped flap functions or doubles as one side of the slot. The flap operably engages the tab such that a frictional force is created, holding the tab securely within the lock.

The flap significantly extends into the cut open slot, such that stacking tabs may have to contact the flap to fully extend through the slot. As a result, the tab may push the flap with an upward force while extending through the slot. To accommodate this force, the tongue lock's flap further contains a perforated back line of demarcation that enables the flap to pivot upwards. The pivot allows the tab to fit though the open slot while simultaneously increasing the frictional contact between the lock and the tab, holding the lock secure.

As a result, the friction locks can be used with numerous types of containers. For example, since the lock can pivot upwards to accommodate thicker extension tabs or remain straight to accommodate thinner extension tabs, it follows that the lock can accept and operably contact stacking tabs of various widths while still maintaining significant contact. Likewise, an open-topped container with a slightly thinner width can still be used with the same dust cover, as the flap can bend upward to accept the tab even if the tab is located close to the back pivot line.

The lock further comprises reinforcing tape embedded within the paperboard of the dust cover or bottom panel to increase tear resistance. The tape extends along one or both sides of the cover or panel, reinforcing the area between the locks and the edges of the cover or panel, and borders the cut open slot on three sides, preventing the fraying and weakening of the paperboard surrounding the slot as stress is applied, thereby increasing the effectiveness and reusability of the tongue friction lock. Preferably, the tape comprises continuous strands of high tensile strength filaments that are coated and impregnated with hot melt adhesive.

Other embodiments include friction locks with flaps of shapes other than a tongue shape, such as a V-shape or a rectangular shape. Further, any number of friction locks can be integrally scored and cut into the dust cover or bottom panel in any formation to accommodate open-topped containers with tabs in countless configurations.

Further, the dust. covers described herein are generally designed to function with typical open-topped containers having multiple tabs extending coplanar to the side walls, wherein the tabs are configured in a "footprint" (an arrangement) commonly used in the industry. The industry standard enables a manufacturer to create limited varieties of dust covers or bottom panels for use with the vast majority of open-topped containers. Beyond this, the dust covers of the present invention can be scored and cut in any arrangement to fit on any open-topped container, regardless of whether the container includes a footprint standard.

Other objects, embodiments, features and advantages of the present invention will be apparent when the description of a preferred embodiment of the invention is considered in conjunction with the annexed drawings, which should be construed in an illustrative and not limiting sense.

BRIEF DESCRIPTION OF THE FIGURES/DRAWINGS

FIG. 1 is a plan view of a dust cover used to cover an open-topped container.

FIG. 2 is a plan view of an alternate embodiment of a dust cover used to cover an open-topped container.

DETAILED DESCRIPTION OF PREFERRED EMBODIMENTS

Figure 3:
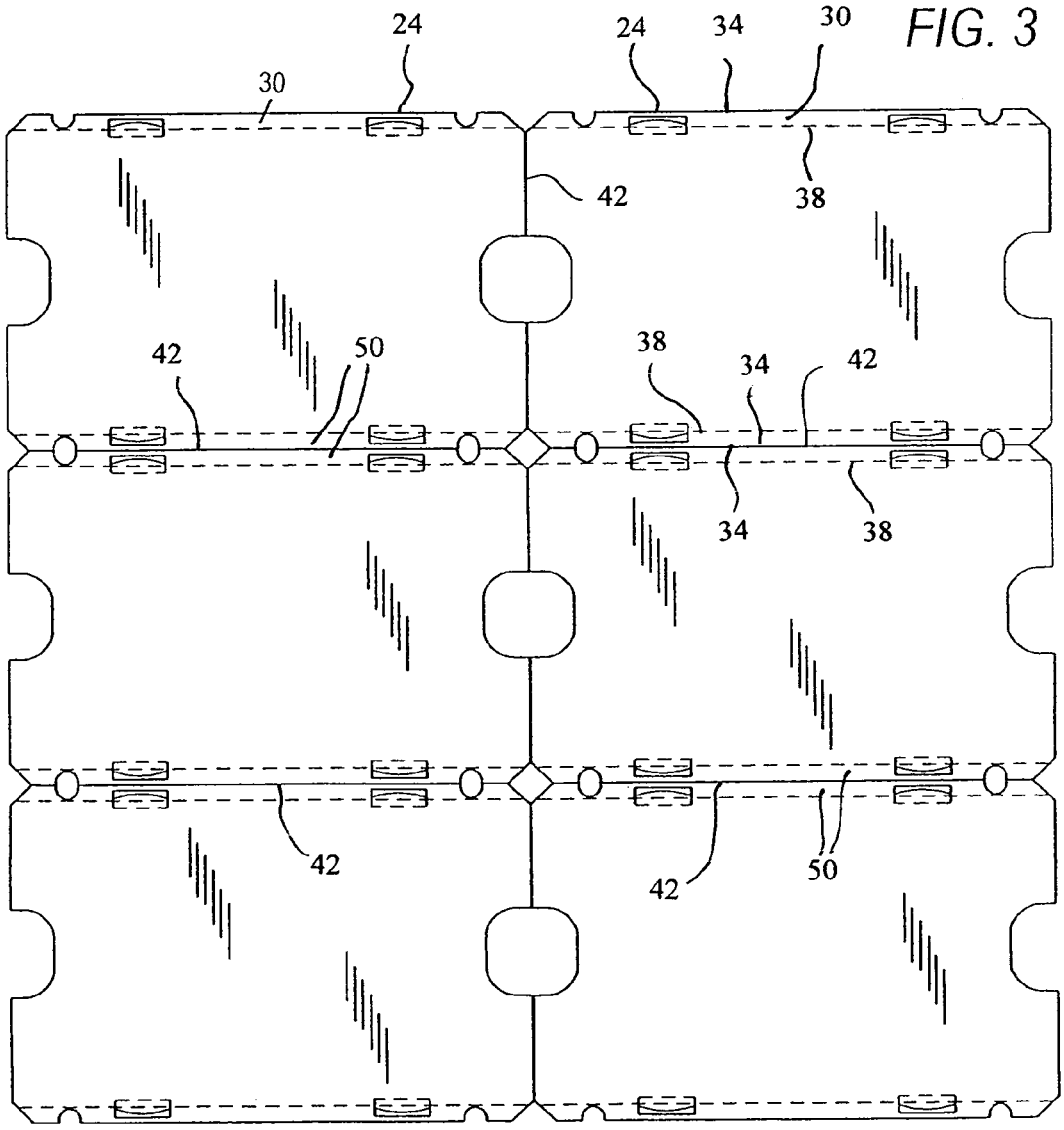
FIG. 3 is a plan view of multiple dust covers contained on a single substrate prior to severing the substrate into individual dust covers.

A dust cover scored in accordance with one embodiment of the invention is shown in FIG. 1. Cover 10 is shaped and scored for the purpose of fitting onto the top of an open-topped container suitable for holding, shipping or stacking a wide variety of objects, such as perishable agricultural products. The cover is preferably made of corrugated paperboard or any type of flexible container material known in the art that is firm enough to create frictional contact and secure connections between a top panel and stacking tab, yet flexible enough to bend along score lines, and is suitable for the shipping and transporting of a wide variety of food items. The cover is substantially rectangular in shape, with a length and width largely identical to the length and width of a corresponding open-topped container. However, the exact length and width of the dust cover can vary greatly as long as the container is properly covered.

The cover of FIG. 1 is designed for use with open-topped containers that have a bottom panel and four side walls, wherein at least one extension tab extends upward from the top edge of the container, coplanar to at least one side wall. The tab extends through a friction lock 40 of the dust cover, thereby providing a container with a lid (dust cover.) In other embodiments, the friction lock may be cut into a bottom panel of an adjacently stacked container, wherein the bottom panel is made of the flexible material, thereby providing a stack of multiple containers. Such uses can be combined, for example, by having four containers stacked on top of one another, with the top container having a dust cover.

Cover 10 has grip recesses 12, breathing holes 14, and multiple friction locks 40, comprising cut open slots 20 for the acceptance of stacking tabs. In the example shown, the slots are coupled with flaps 16 integrally connected to the cover and bordering one side of slots 20. Each of the friction locks 40 is formed by cutting and scoring, and is positioned near the cover's outer edge to correspond with the positions of an adjacent container's stacking tabs. The present example contains four tongue friction locks configured around the cover in a common footprint. However, as stated above, the exact configuration of the friction locks can change in accordance with the configuration of the corresponding stacking tabs. For one example, in FIG. 2, a half sized dust cover is shown wherein only two friction tongue locks are formed within the cover, corresponding to a half-sized open-topped container with two stacking tabs.

Returning to FIG. 1, flap 16 is a tongue shaped flap with a back pivot line 18, a front tongue shaped extension 22, and two side walls 26 and 28. (The view seen in FIG. 1 is the top side of dust cover 10, and thus the top side of lock 16.) The flap has a length, width and thickness, wherein the thickness is equal to the thickness of the rest of the dust cover, and the length and width can vary within the scope of the invention as long as the flap properly engages a stacking tab. Pivot line 18 is preferably a perforated line between cover 10 and lock 40 upon which the flap can pivot in an upwards direction.

Side walls 26 and 28 are incisions that extend entirely though the thickness of the dust cover from the pivot line 18 to the tongue shaped flap extension 22. The side walls extend parallel to each other and perpendicular to the pivot line. The side wall incisions enable the flap to extend upward about the pivot line without encountering undue resistance from the part of the dust cover that borders that side of the tongue lock.

Tongue extension 22 extends from side wall 26 to side wall 28 in a slight, tongue shaped outward arc. When a stacking tab enters slot 20, the extension 22 will significantly contact the tab, causing friction and holding it securely in place. Generally, the outer most portion of the tab, or the portion that is furthest from the pivot line, will be the part of the extension that contacts the tab.

The curved edge of tongue extension 22 protrudes into the cut open slot 20. Slot 20 lies between extension 22 and narrow strip 24, and further comprises side walls 26 and 28 and a top edge (a bottom edge of narrow strip 24). The slot's width is great enough so that a stacking tab can extend through the slot between side walls 26 and 28. However, the length between strip 24 and extension 22 is equal to or less than the thickness of a stacking tab inserted through the slot. This forces the tabs to press against the flap (luring insertion to form a positive locking mechanism.

In accordance with an important aspect of the invention, reinforcing-tape 30 is embedded inside the cover and extends along at least one edge of the cover, from outer edge 34 of the dust cover to an inner tape line 38. The tape reinforces slot 20 along its side walls and top edge, and reinforces narrow strip 24. The reinforcing tape provides tear resistance in the narrow strip, enabling one to repeatedly insert and remove a locking tab without significantly damaging the locking mechanism and the area surrounding it. The reinforcing tape can be any tape known in the art, preferably comprising continuous strands of high tensile strength filaments coated and impregnated with hot melt adhesive.

Tape 30 does not necessarily extend through the entirety of flap 16 or through pivot line 18. However, in the examples shown, a flap is provided, and a portion of the reinforcing tape may remain in the flap. In this circumstance, tape portion 36 extends across the upper portion of the lock, extending from the tongue shaped extension 22 to lower line 38, providing extra resistance in the part of the flap that contacts the stacking tabs (see FIG. 4). In alternative embodiments, inner tape line 38 extends to the opposite side of pivot line 18, thereby completely surrounding the flap with reinforcing tape (see FIG. 5).

FIGS. 1 and 2 depict a dust cover with reinforced friction tongue locks for placement over an open-topped container. Alternatively, as stated above, the friction locks can be scored in a bottom panel of an adjacently stacked open-topped container. Such a container would have a bottom panel with substantially the same advantages as the dust covers of FIGS. 1 and 2, with additional side walls to enclose and hold various items such as produce. The side walls would preferably have tabs that extend upwardly from the top edge of the side walls to facilitate additional stacking. As a result, multiple containers of this embodiment can stack on top of one another utilizing the same friction tongue lock mechanism as the dust cover.

FIG. 3 depicts multiple dust covers cut and scored together on a single web of flexible material, such as paperboard. The dust covers are eventually separated along severance lines 42 to formulate multiple dust covers with virtually identical functions and advantages. Reinforcing tapes 30 may have variant widths across the web to ensure that narrow strips 24 and open slots 20 are properly reinforced. For example, if a minimum width of ⅝ inch is required to reinforce the narrow strip and cut out slots, a user may choose to utilize a reinforcing tape with ¾ inch width to account for natural variances in the formation of the dust cover. In this regard, a single strip of tape 50 having a width of 1½ inches can be applied along the web, with the cut lines 42 bisecting the tape so that each dust cover cut from the web will have a strip of tape ¾ inch wide along its edges.

Figure 4:
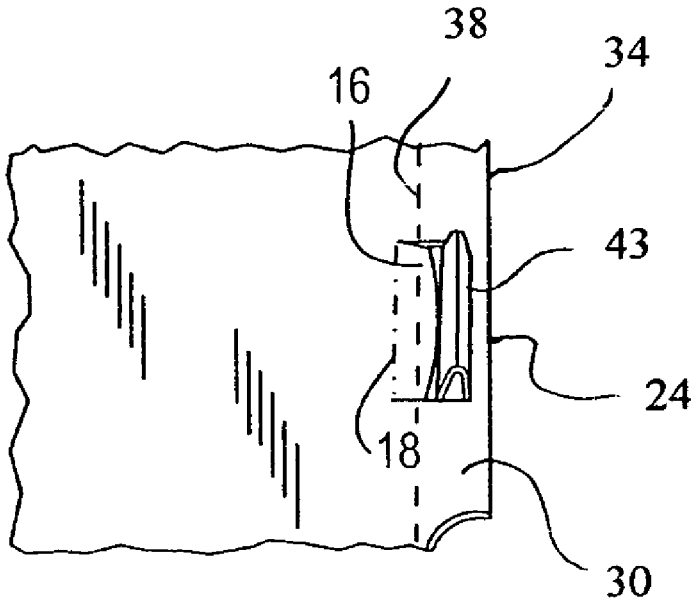
FIG. 4 is a top view of a tab extending through a cut-open slot. and held in place by a friction lock.

FIG. 4 depicts a stacking tab 43 inserted through the slot 20 and held firm by the locking mechanism of flap 16. In this embodiment, the tab fits through slot 20 without pivoting flap 16 along pivot line 18. A positive locking mechanism is created by the contact between the flap extension 22 and tab 43.

Figure 5:
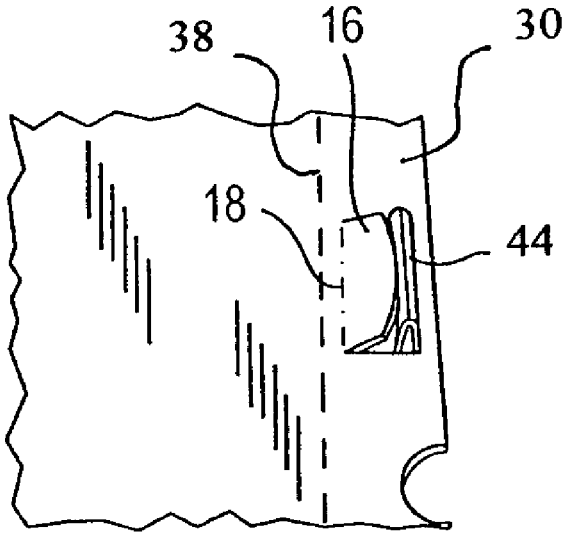
FIG. 5 is a top view of a tab extending through a cut-open slot, forcing the friction lock to pivot upwards along a back. pivot line while holding the tab in. place.

A different tab is shown in FIG. 5, wherein the stacking tab 44 places a vertical force directly on flap 16. For example, the tab may he on a container that is slightly thinner than the container of FIG. 4, thereby moving the stacking tab closer to pivot line 18. Alternatively, tab 44 may be thicker than the tab in FIG. 4, thereby necessarily contacting more of flap 16. To adapt to these possibilities, flap pivots upward along pivot line 18 to accommodate the stacking tab by allowing the tab to fully enter slot 20. A positive friction lock is thereby created between the engagement of stacking tab 44 by flap 16, holding the tab secure within the lock, and consequently attaching the dust cover or container bottom to the lower, adjacent open-topped container in a secure but removable manner.

The strips of reinforcing tape along the edges of the dust cover reinforce the edges, especially in the area adjacent the friction locks, providing tear resistance to the narrow strip of material between the slots and the outer edge of the cover.

Although the invention has been described with reference to preferred embodiments, it will be appreciated by one of ordinary skill in the art that numerous modifications are possible in light of the above disclosure. For example, other types of score or cut lines that sufficiently allow the flap to pivot may be used. For example, the back pivot may be scored as something other than a perforated line, such as a crease line, wherein the paperboard is cut with a vertical incision that extends downward from beneath the crease line to the edge of the bottom side of the cover. The incision can be a long, thin cut in the same vertical plane as the crease line, that extends through a fraction of the dust cover. The exact fraction can vary, ranging from a very slight incision on the bottom side over to an incision that up to just beneath the crease line. All such variations and modifications are intended to be within the scope and spirit of the invention as defined in the claims appended hereto.

I claim:

1. A flat, planar dust cover having free outer edges and formed of a flexible material, said dust cover having a friction locking mechanism for securing the dust cover to an open-topped container, said friction locking mechanism comprising at least one cut-out slot formed adjacent a free outer edge of the dust cover, said cut-out slot having a front edge defined by a narrow strip of said flexible material between said slot and said adjacent free outer edge of said dust cover, a back edge, and two side edges, at least one bendable flap in the slot, having a front edge spaced from but adjacent to the front edge of the slot, a back pivot line coinciding with the back edge of the slot, and two side incision lines coinciding with the side edges of the slot, wherein said flap can pivot along said back pivot line in an upwards direction, and a strip of reinforcing tape extends through said narrow strip to increase tear resistance of said dust cover, said strip of reinforcing tape having a width to extend from said adjacent free outer edge to an inner location spaced beyond said front edge of the slot and extending over at least a front edge portion of said flap.

2. The dust cover as claimed in claim 1, wherein said back pivot line comprises a perforated line across said flexible material.

3. The dust cover as claimed in claim 1, wherein said reinforcing tape is embedded in said flexible material such that said reinforcing tape extends through said narrow strip.

4. The dust cover as claimed in claim 1, wherein said reinforcing tape is embedded in said flexible material such that said reinforcing tape surrounds said cut-out slot along said front edge and two side edges of the slot.

5. The dust cover as claimed in claim 1, wherein the front edge of said flap is arcuate.

6. The dust cover as claimed in claim 1, wherein said dust cover has four of said locking mechanisms.

7. The dust cover as claimed in claim 1, wherein:

a said cut-out slot is formed through said dust cover adjacent each of two opposed edges, each slot leaving a narrow strip of material between it and the adjacent free outer edge, and a strip of reinforcing tape extends along each of said edges to reinforce the narrow strips of material.

8. The dust cover as claimed in claim 7, wherein:

the strips of reinforcing tape each has a width at least as great as the width of each said narrow strip of material.

9. The dust cover as claimed in claim 8, wherein:

said strip of reinforcing tape has a width to extend across said dust cover from said free outer edge almost to said back edge of said slots.

* * * * *